US007385344B2

(12) United States Patent
Hwang

(10) Patent No.: US 7,385,344 B2
(45) Date of Patent: Jun. 10, 2008

(54) ELECTRON EMISSION DEVICE INCLUDING DUMMY ELECTRODES

(75) Inventor: Seong-Yeon Hwang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 119 days.

(21) Appl. No.: 11/020,570

(22) Filed: Dec. 27, 2004

(65) Prior Publication Data

US 2005/0140269 A1 Jun. 30, 2005

(30) Foreign Application Priority Data

Dec. 26, 2003 (KR) ..... 10-2003-0097893
Jan. 30, 2004 (KR) ..... 10-2004-0005966

(51) Int. Cl.
*H01J 1/62* (2006.01)

(52) U.S. Cl. ..... 313/495; 313/309; 313/336; 313/351

(58) Field of Classification Search ..... 313/495, 313/309, 310, 336, 351
See application file for complete search history.

(56) References Cited

U.S. PATENT DOCUMENTS 5,637,951 A * 6/1997 Parker ..... 313/336
5,703,610 A * 12/1997 Kishino et al. ..... 345/75.2
5,729,086 A 3/1998 Jeong et al.
6,018,215 A * 1/2000 Takemura ..... 313/309

FOREIGN PATENT DOCUMENTS

| | | |
|---|---|---|
| CN | 1136215 | 11/1996 |
| JP | 07-029521 | 1/1995 |
| JP | 08-153460 | 6/1996 |
| JP | 2000-082428 | 3/2000 |
| JP | 2001-023510 | 1/2001 |
| JP | 2001-210223 | 8/2001 |
| JP | 2001-324956 | 11/2001 |
| JP | 2003-242914 | 8/2003 |
| JP | 2003-331713 | 11/2003 |

* cited by examiner

*Primary Examiner*—Vip Patel
(74) *Attorney, Agent, or Firm*—Robert E. Bushnell, Esq.

(57) ABSTRACT

An electron emission device having various functional electrodes in addition to the electrodes serving to emit electrons includes: first and second substrates facing each other, and cathode and gate electrodes arranged on the first substrate within an effective electron emission area and including an insulating layer interposed therebetween. The electron emission regions are electrically connected to the cathode electrodes. At least one dummy electrode is arranged external to the effective electron emission area. At least one anode electrode is arranged on the second substrate. Phosphor layers are arranged on one surface of the anode electrode.

15 Claims, 13 Drawing Sheets

ELECTRON EMISSION DEVICE INCLUDING DUMMY ELECTRODES

CLAIM OF PRIORITY

This application makes reference to, incorporates the same herein, and claims all benefits accruing under 35 U.S.C. §119 from an applications earlier filed in the Korean Intellectual Property Office on 26 Dec. 2003 and 30 Jan. 2004 and there duly respectively assigned Ser. Nos. 2003-97893 and 2004-5966.

BACKGROUND OF THE INVENTION

1. Field of the Invention

The present invention relates to an electron emission device, and in particular, to an electron emission device and a method of manufacture thereof in which the electron emission device has various functional electrodes in addition to the electrodes serving to emit electrons.

2. Description of Related Art

Generally, electron emission devices are classified into a first type where a hot cathode is used as an electron emission source, and a second type where a cold cathode is used as the electron emission source. Among the second type of electron emission devices are a Field Emitter Array (FEA) device, a Metal-insulator-metal (MIM) device, a Metal-insulator-semiconductor (MIS) device, a Surface Conduction Emitter (SCE) device, and a Ballistic electron Surface Emitter (BSE) device.

In the FEA electron emission device, electron emission regions are formed by a material emitting electrons under the application of an electric field, and driving electrodes, such as cathode and gate electrodes, arranged around the electron emission regions. When an electric field is formed around the electron emission regions due to the voltage difference between the two electrodes, electrons are emitted from the electron emission regions.

The cathode and the gate electrodes cross each other while interposing an insulating layer, thereby forming a matrix structure. When the crossed region of the two electrodes is defined as a pixel region, the electron emission at the respective pixels is controlled by the scan signal applied to any one of the electrodes and the data signal applied to the other electrode. A square wave is applied to the cathode and the gate electrodes, the square wave having both Direct Current (DC) characteristics as well as Alternating Current (AC) characteristics. The square wave is a relatively high voltage, and has a short "ON" time that varies somewhat depending upon the number of pixels.

Accordingly, with the usual electron emission device, the driving waveform can be easily distorted due to the internal factors of the device, such as the internal resistance of the cathode and gate electrodes, and the electric potentials accumulated between the two electrodes. More particularly, among the electrodes receiving the scan signals, signal distortion can easily occur with the row of electrodes first receiving the scan signal and with the row of electrodes last receiving the scan signal.

When the signal distortion occurs during the driving of the electron emission device, unnecessary electron emission occurs at the signal-distorted pixels, or the necessary electron emission does not occur at the relevant pixels. As a result, the correct on/off control of the pixels becomes impossible, and a precise image display does not occur.

With most electron emission devices, the inner space thereof is exhausted to be in a vacuum state, and a remnant gas therein is collected and removed using a getter, thereby heightening the degree of vacuum.

The getters are classified into evaporable getters, and non-evaporable getters. The evaporable getter is well adapted for a vacuum display device with a sufficient inner space, such as a cathode ray tube, and has excellent remnant gas collection efficiency. However, most of the electron emission devices have a very narrow inner space as the distance between the front and the rear substrates thereof is 2 mm or less. Therefore, it is difficult to arranged a getter with a predetermined volume in a narrow inner space, and to apply the evaporable getter due to the narrow space between the electrodes arranged on the substrate. With the electron emission device, a non-evaporable getter is installed external to the display region, and activated to remove the remnant gas after the exhausting.

However, compared to the evaporable getter, the non-evaporable getter has a low remnant gas collection efficiency, and hence, it is difficult to increase the degree of vacuum. This makes the device structure and the processing steps complicated. Particularly with the FEA typed electron emission device using a carbonaceous material for the electron emission regions, the carbonaceous material easily reacts with a particular remnant gas, such as oxygen, and reduces the life span and the electron emission efficiency of the electron emission regions. Consequently, with the electron emission device using a carbonaceous material, the remnant oxygen-containing gas should be removed after the exhausting, and this is effected with gettering.

SUMMARY OF THE INVENTION

In one exemplary embodiment of the present invention, an electron emission device is provided which inhibits signal distortion, and prevents the screen quality from being deteriorated.

In another exemplary embodiment of the present invention, an electron emission device is provided which effectively collects the inner remnant gas after the exhausting, and effects a high degree of vacuum.

In an exemplary embodiment of the present invention, the electron emission device includes first and second substrates facing each other, and cathode and gate electrodes arranged on the first substrate within an effective electron emission area and including an insulating layer interposed therebetween. Electron emission regions are electrically connected to the cathode electrodes. At least one dummy electrode is arranged external to the effective electron emission area. At least one anode electrode is arranged on the second substrate. Phosphor layers are arranged on one surface of the anode electrode.

The dummy electrode includes at least one of a first dummy electrode arranged external to an outermost cathode electrode and parallel thereto, and a second dummy electrode arranged external to an outermost gate electrode and parallel thereto. An insulating layer is disposed between the first and the second dummy electrodes.

In another exemplary embodiment of the present invention, the electron emission device has first and second substrates facing each other, first electrodes arranged on the first substrate and adapted to receive scan signals, and second electrodes insulated from the first electrodes by an insulating layer and adapted to receive data signals. Electron emission regions are electrically connected to either the first electrodes or the second electrodes. At least one dummy electrode is arranged external to the outermost first electrode.

The first electrodes are cathode electrodes, and the second electrodes are gate electrodes arranged under the cathode electrodes and including the insulating layer interposed therebetween. The electron emission regions are arranged on the first electrodes.

The first electrodes are gate electrodes, and the second electrodes are cathode electrodes arranged under the gate electrodes and including the insulating layer interposed therebetween The electron emission regions are arranged on the second electrodes.

In another exemplary embodiment of the present invention, the electron emission device includes first and second substrates facing each other, and cathode and gate electrodes arranged on the first substrate within an effective electron emission area and including an insulating layer interposed therebetween Electron emission regions are electrically connected to the cathode electrodes. At least one dummy electrode is arranged external to the effective electron emission area with a getter layer. At least one anode electrode is arranged on the second substrate. Phosphor layers are arranged on one surface of the anode electrode. A sealing member is arranged at the peripheries of the first and the second substrates and surrounding the dummy electrode to seal the two substrates together.

The dummy electrode includes a first dummy electrode arranged external to an outermost cathode electrode and parallel thereto, and a second dummy electrode arranged external to an outermost gate electrode and parallel thereto. The getter layer is arranged on at least one of the first and the second dummy electrodes.

The getter layer is formed of a non-evaporable getter material. The getter layer is preferably formed of one of an alloy of zirconium, vanadium and iron, and an alloy of zirconium and aluminum. The getter layer is formed on the dummy electrode and the insulating layer in the direction of the dummy electrode.

The getter layer is alternatively formed of an electron emission material. The electron emission regions and the getter layer contain at least one of a carbonaceous material and a nanometer-sized material.

The amount of electron emission material of the getter layers formed on one of the dummy electrodes is greater than the amount of electron emission material of the electron emission regions formed on one of the cathode electrodes.

In a method of manufacturing the electron emission device, an electron emission unit is formed on the first substrate within an effective electron emission area, and at least one dummy electrode is formed external to the effective electron emission area. A getter layer is formed on the dummy electrode with a non-evaporable getter material. A light emission unit is formed on a second substrate. The peripheries of the first and the second substrates are sealed together with a sealing member, and an inner space between the first and the second substrates is exhausted. The getter layer is activated by applying a current to the dummy electrode.

In another method of manufacturing the electron emission device, an electron emission unit is formed on a first substrate within an effective electron emission area, and at least one dummy electrode is formed external to the effective electron emission area. A getter layer is formed on the dummy electrode with an electron emission material. A light emission unit is formed on the second substrate. The peripheries of the first and the second substrates are sealed together with a sealing member, and an inner space between the first and the second substrates is exhausted. An electric field is applied to the getter layer to emit electrons from the getter layer, and the electron emission material of the getter layer reacts with a remnant gas to collect and remove the gas.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention will be described more fully hereinafter with reference to the accompanying drawings, in which exemplary embodiments of the invention are shown.

Figure 1:
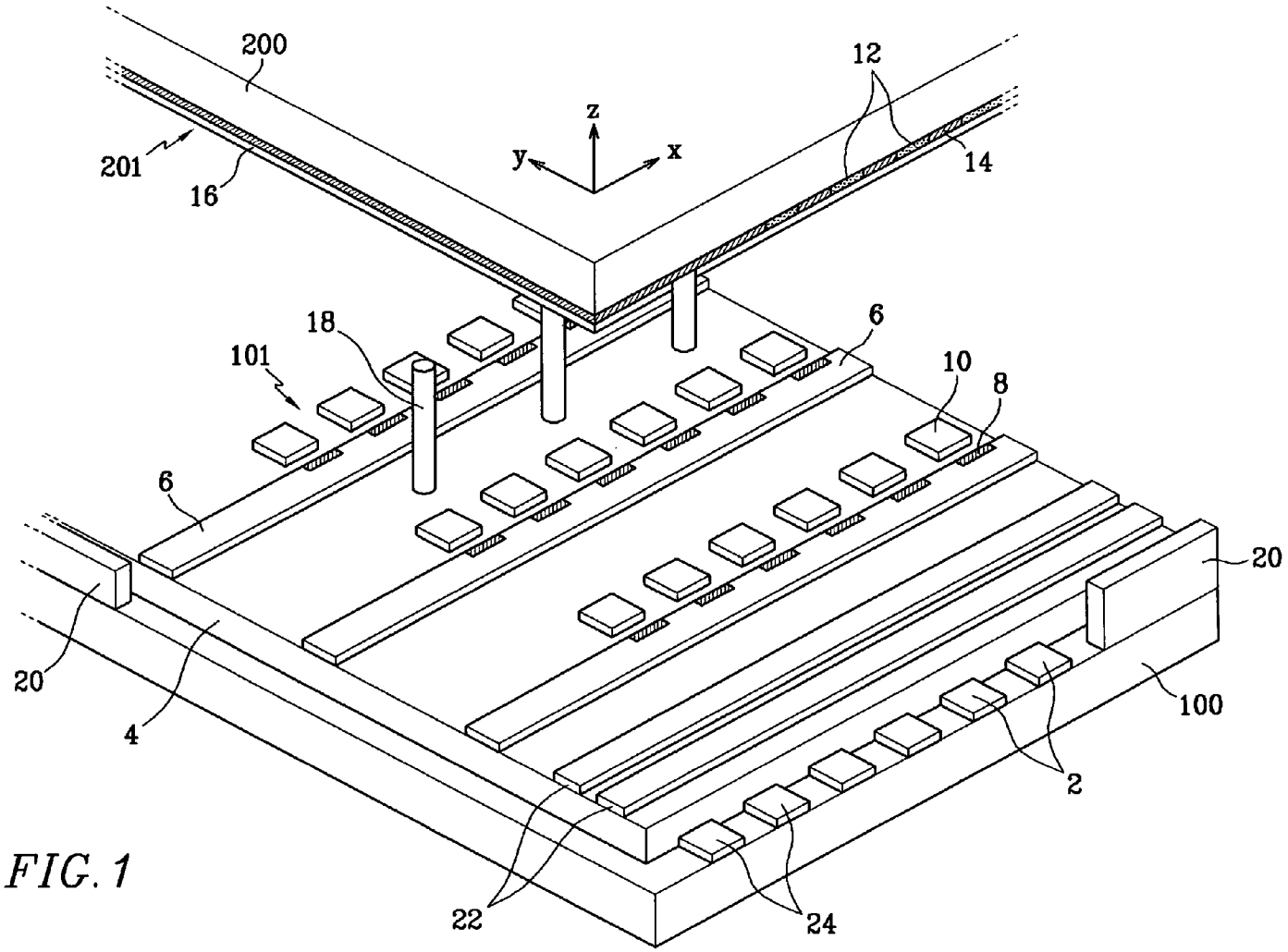
FIG. 1 is a partial exploded perspective view of an electron emission device according to a first embodiment of the present invention.
Figure 2:
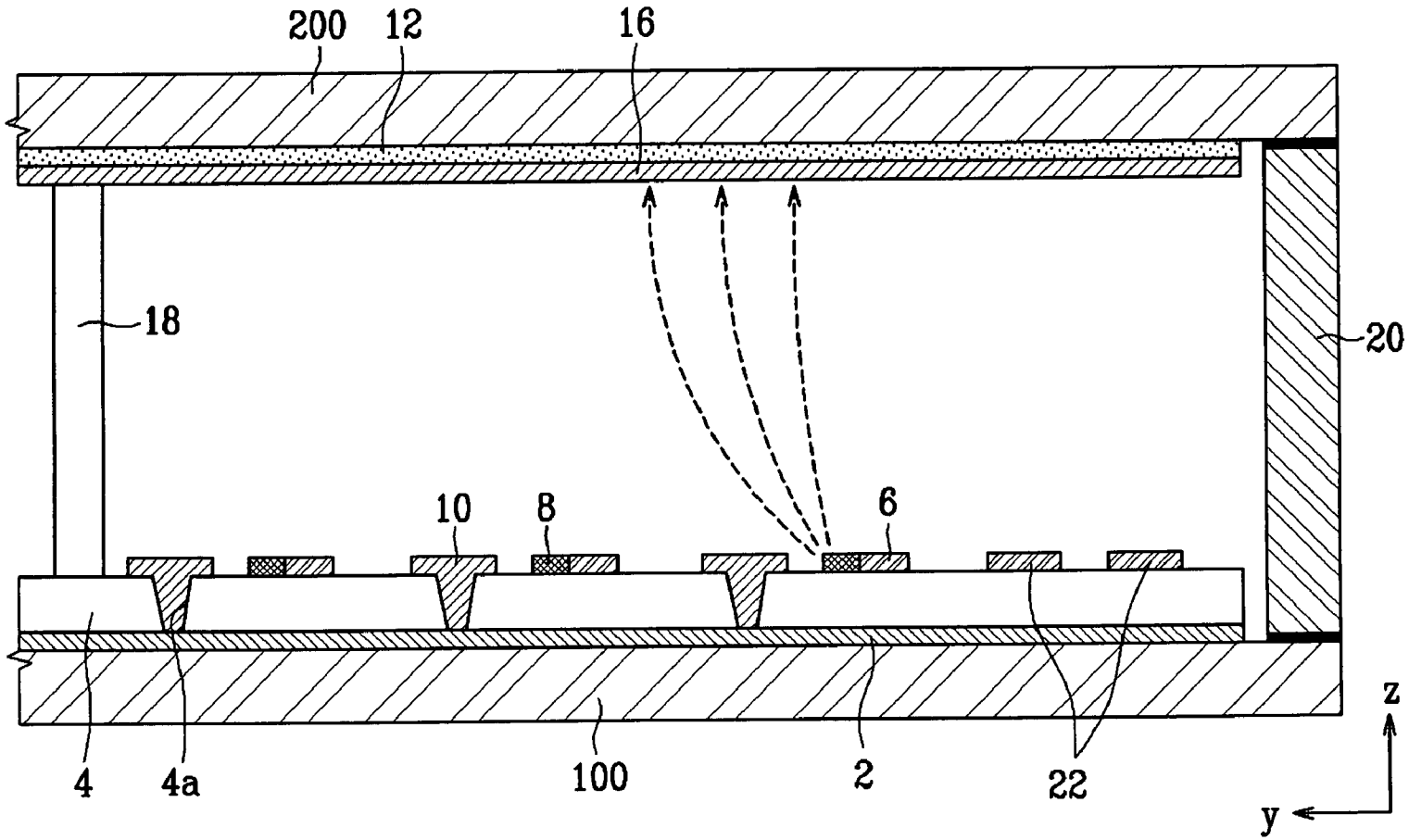
FIG. 2 is a partial sectional view of the electron emission device of FIG. 1, illustrating the combinatorial state thereof.

FIG. 1 is a partial exploded perspective view of an electron emission device according to a first embodiment of the present invention, and FIG. 2 is a partial sectional view of the electron emission device, illustrating the combinatorial state thereof.

As shown in the drawings, the electron emission device includes first and second substrates 100 and 200 facing each other with a distance while forming a vacuum vessel. An II electron emission unit 101 is provided on the first substrate 100 to emit electrons under the application of an electric field, and a light emission unit 201 is formed on the second substrate 200 to radiate visible rays due to the electrons emitted from the electron emission unit 101.

Specifically, gate electrodes 2 are line-patterned on the first-substrate 100 in one direction (in the Y direction of the drawing), and an insulating layer 4 is formed on the entire surface of the first substrate 100 while covering the gate electrodes 2. Cathode electrodes 6 are line-patterned on the insulating layer 4 in a direction (in the X direction of the drawing) crossing the gate electrodes 2. The crossed region of the gate and the cathode electrodes 2 and 6 is defined as a pixel region. Electron emission regions 8 are formed on a one-sided periphery of the cathode electrodes 6 at the respective pixel regions.

In this embodiment, the electron emission regions 8 are formed with a carbonaceous material or a nanometer-sized material emitting electrons under the application of an electric field. The electron emission material for forming the electron emission regions 8 is selected from carbon nanotubes, graphite, graphite nano-fibers, diamonds, diamond-like carbon, $C_{60}$, silicon nano-wires and combinations thereof.

Counter electrodes 10 are placed on the first substrate 100 to pull up the electric field of the gate electrodes 2 to the insulating layer 4. The counter electrodes 10 contact the gate electrodes 2 through via holes 4*a* formed at the insulating layer 4 while being electrically connected thereto. The counter electrodes 10 face the electron emission regions 8 between the cathode electrodes 6 with a distance. The counter electrodes 10 make it easy to emit electrons by applying strong electric field around the electron emission regions 8, and lower the driving voltage.

Red, green and blue phosphor layers 12 are arranged on the second substrate 200 facing the first substrate 100 while being spaced apart from each other, and black layers 14 are formed between the phosphor layers 12 to enhance the screen contrast. An anode electrode 16 is formed on the phosphor layers 12 and the black layers 14 by depositing a metallic material, such as aluminum. The anode electrode 16 receives an externally supplied voltage required for accelerating the electron beams, and enhances the screen brightness by the metal back effect.

The anode electrode can be formed of a transparent conductive material, such as Indium Tin Oxide (ITO), rather than by a metallic material. In this case, an anode electrode (not shown) of a transparent conductive material is first formed on the second substrate 200, and phosphor layers 12 and black layers 14 are formed on the anode electrode. When needed, a metallic layer can be formed on the phosphor layers 12 and the black layers 14 to enhance the screen brightness. The anode electrode can be formed over the entire area of the second substrate 200, or partitioned with a predetermined pattern.

A plurality of spacers 18 are arranged between the first and the second substrates 100 and 200 to maintain a constant distance therebetween. A side bar 20 is disposed between the first and the second substrates 100 and 200 at the peripheries thereof and the side bar 20 and the first and the second substrates 100 and 200 are joined by frit sealing. The vessel formed with the first and the second substrates 100 and 200 and the side bar 20 is exhausted through an exhaust (not shown) to be in a vacuum state.

Figure 3:
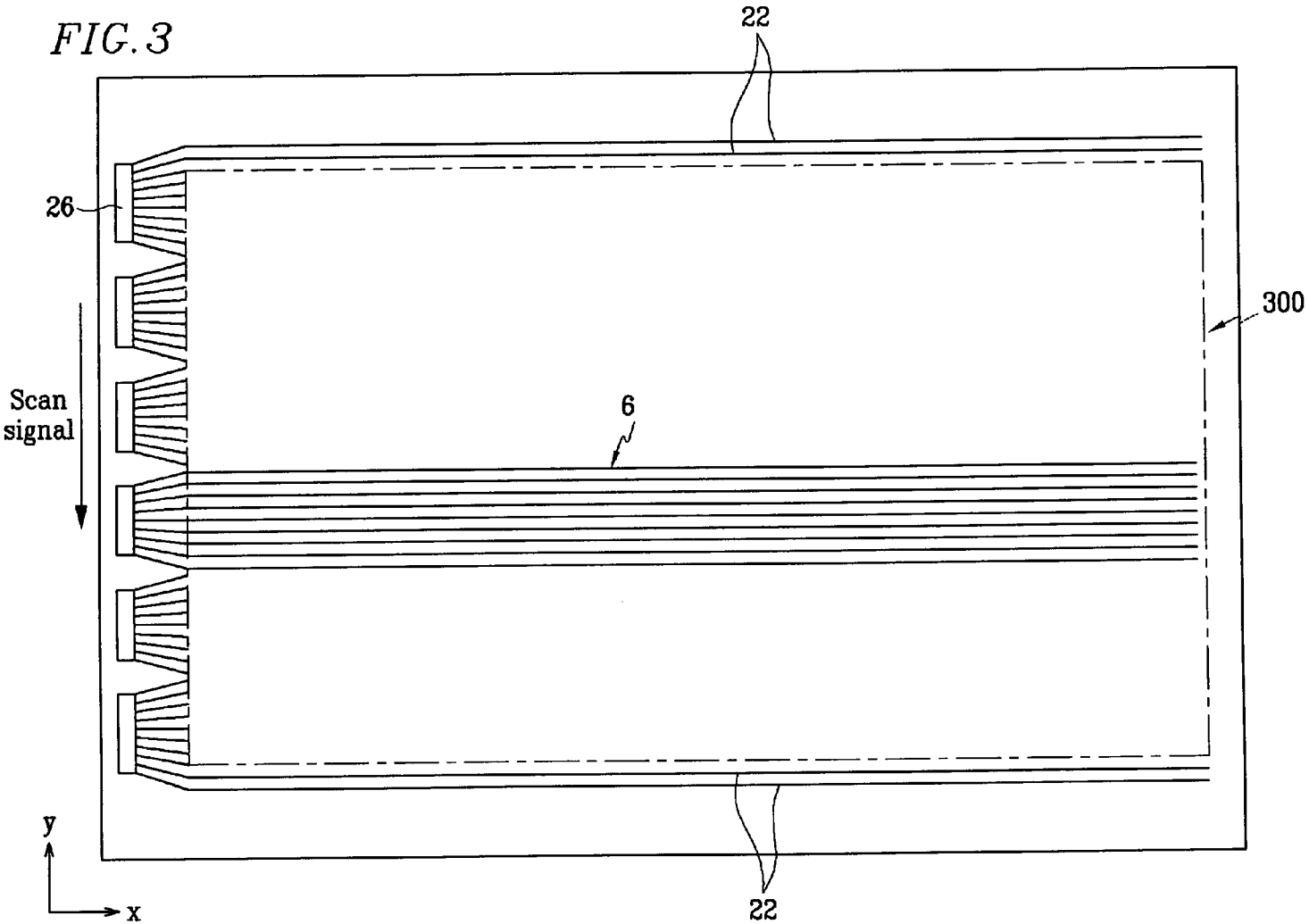
FIG. 3 is a schematic view of cathode electrodes of the electron emission device according to the first embodiment of the present invention.
Figure 4:
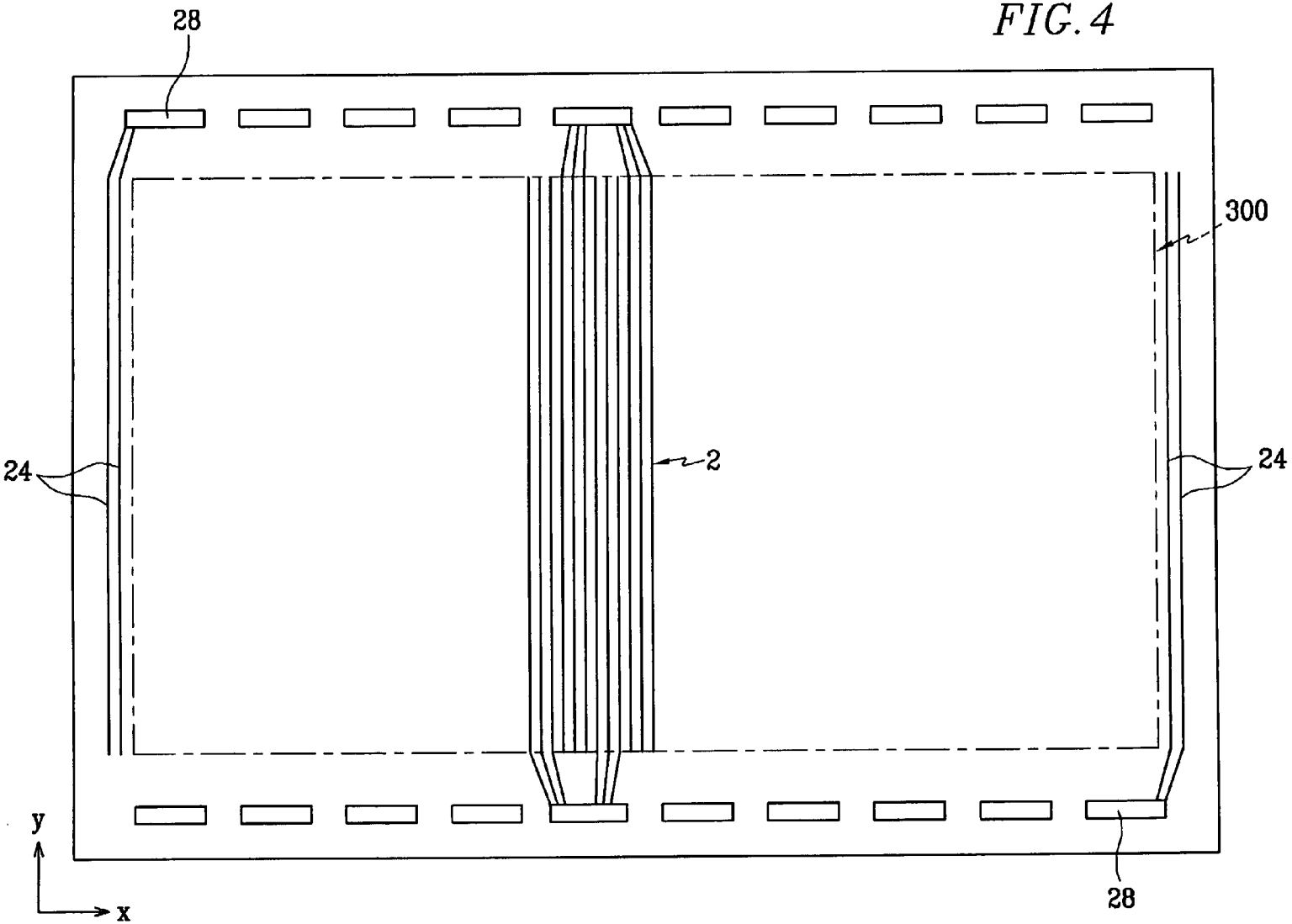
FIG. 4 is a schematic view of gate electrodes of the electron emission device according to the first embodiment of the present invention.

FIGS. 3 and 4 respectively illustrate the cathode electrodes and the gate electrodes of FIG. 1.

As shown in the drawings, an effective electron emission area 300 is defined to be the area where the cathode and the gate electrodes 6 and 2 cross each other while forming a matrix structure and the electron emission regions 8 on the cathode electrodes 6 to emit electrons. Extra electrodes not serving to make the image display, that is, dummy electrodes 22 and 24 are formed external to the effective electron emission area 300.

In this embodiment, the dummy electrodes 22 and 24 are formed with first dummy electrodes 22 placed external to the outermost cathode electrode 6 parallel thereto and connected to scan signal transmitters 26 together with the cathode electrodes 6, and second dummy electrodes 24 placed external to the outermost gate electrode 2 parallel thereto and connected to data signal transmitters 28. As shown in FIG. 1, the first and the second dummy electrodes 22 and 24 are insulated from each other while interposing an insulating layer 4 therebetween.

One or more of the first dummy electrodes 22 are placed external to the upper and lower sides of the effective electron emission area 300. In the drawing, two first dummy electrodes 22 are respectively provided external to the upper and lower sides of the effective electron emission region 300. One or more of the second dummy electrodes 24 are placed external to the left and right sides of the effective electron emission area 300. In the drawing, two second dummy electrodes 24 are respectively provided external to the left and right sides of the effective electron emission area 300.

Although the first dummy electrodes 22 are placed external to the outermost cathode electrode 6 and the second dummy electrodes 24 are placed external to the outermost gate electrode 2, the dummy electrodes can be provided corresponding to one of the cathode electrodes 6 and the gate electrodes 2, preferably, to the electrode receiving the scan signal.

With the above-structured electron emission device, in operation, externally supplied predetermined voltages are inputted to the gate electrodes 2, the cathode electrodes 6 and the anode electrode 16. For instance, scan signals with negative voltages of several volts to several tens of volts are applied to the cathode electrodes 6 and data signals with positive voltages of several volts to several tens of volts are applied to the gate, and hundreds of volts to several thousands of volts are applied to the anode electrode 16.

In the pixels supplied with all of the scan and the data signals, an electric field is formed around the electron emission regions 8 due to the voltage difference between the cathode and the gate electrodes 6 and 2, and electrons are emitted from the electron emission regions 8. The emitted electrons are attracted by the high voltage applied to the anode electrode 16, and proceed toward the second substrate 200. The electrons finally strike the corresponding phosphor layers at the relevant pixels, thereby emitting light.

In this embodiment, as the first dummy electrodes 22 are placed external to the outermost cathode electrode 6, when the scan signals of a frame are applied to the cathode electrodes 6 in the direction of the arrow of FIG. 3, they are first applied to the first dummy electrode 22 placed external to the upper end of the effective electron emission area 300, and last of all to the first dummy electrode placed external to the lower end of the effective electron emission area 300. Consequently, the possible signal distortion occurring at the outermost cathode electrode 6 is generated at the first dummy electrode 22 that is not practically serving to display the image.

As a result, the first dummy electrode 22 minimizes the signal distortion occurring within the effective electron emission area 300, and enables the precise on/off control of the respective pixels. The second dummy electrode 24 placed external to the outermost gate electrode 2 also has the same functional role as the first dummy electrode 22.

With the electron emission device according to the embodiment of the present invention, the device stability is heightened without correcting the driving circuit with the first and the second dummy electrodes 22 and 24 or varying the driving method, thereby obtaining stable light emission characteristics. Furthermore, the electron emission device with the first and second dummy electrodes 22 and 24 exerts the above-described effects as well as the following supplementary effects.

First, when electron emission regions are formed at the first dummy electrode 22, an electron emitting experiment or an endurance test not available within the effective electron emission area 300 can be practically effected in the device. Second, when uneven patterning occurs at the outermost electrodes during the electrode formation process through etching, it is concentrated on the dummy electrodes 22 and 24, and hence, stable electrode pattern formation can be effected within the effective electron emission area 300.

Figure 5:
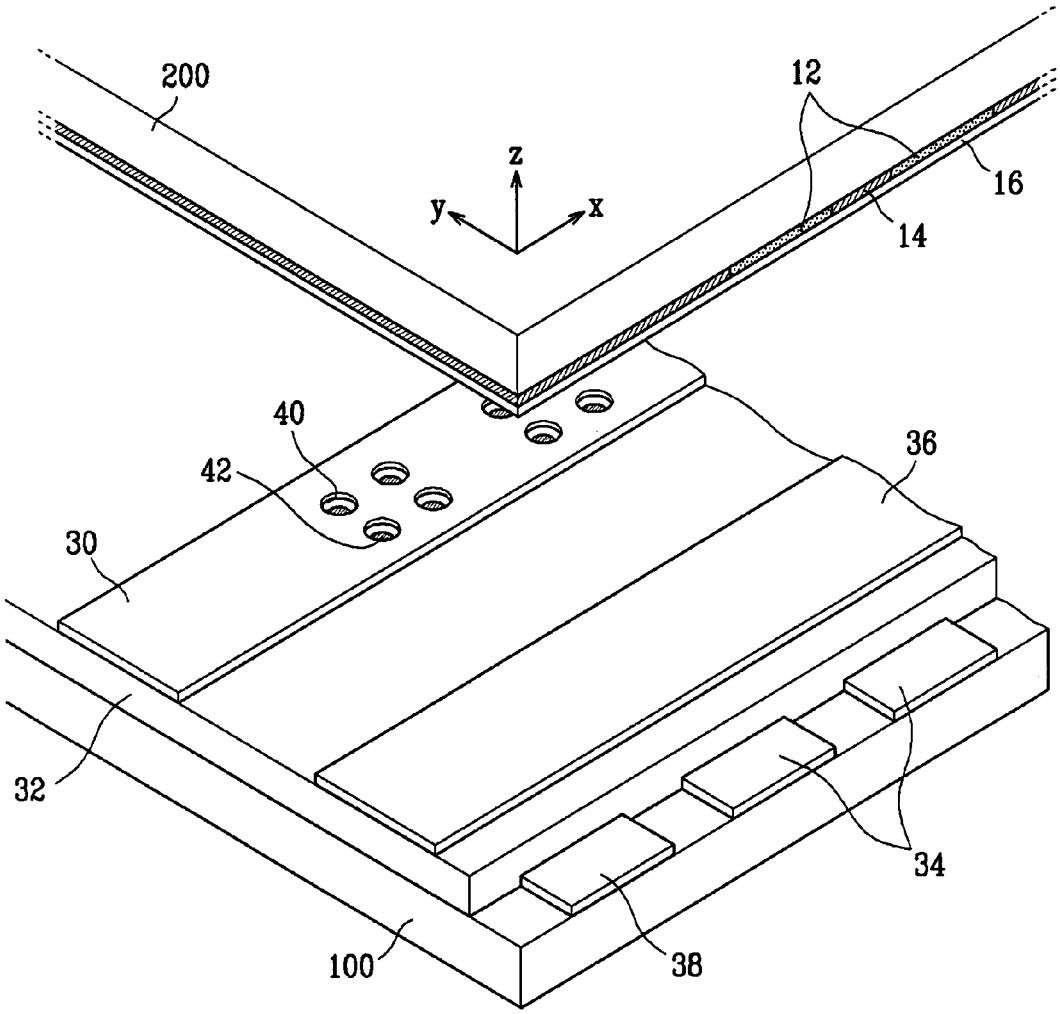
FIG. 5 is a partial exploded perspective view of the electron emission device according to the second embodiment of the present invention.
Figure 6:
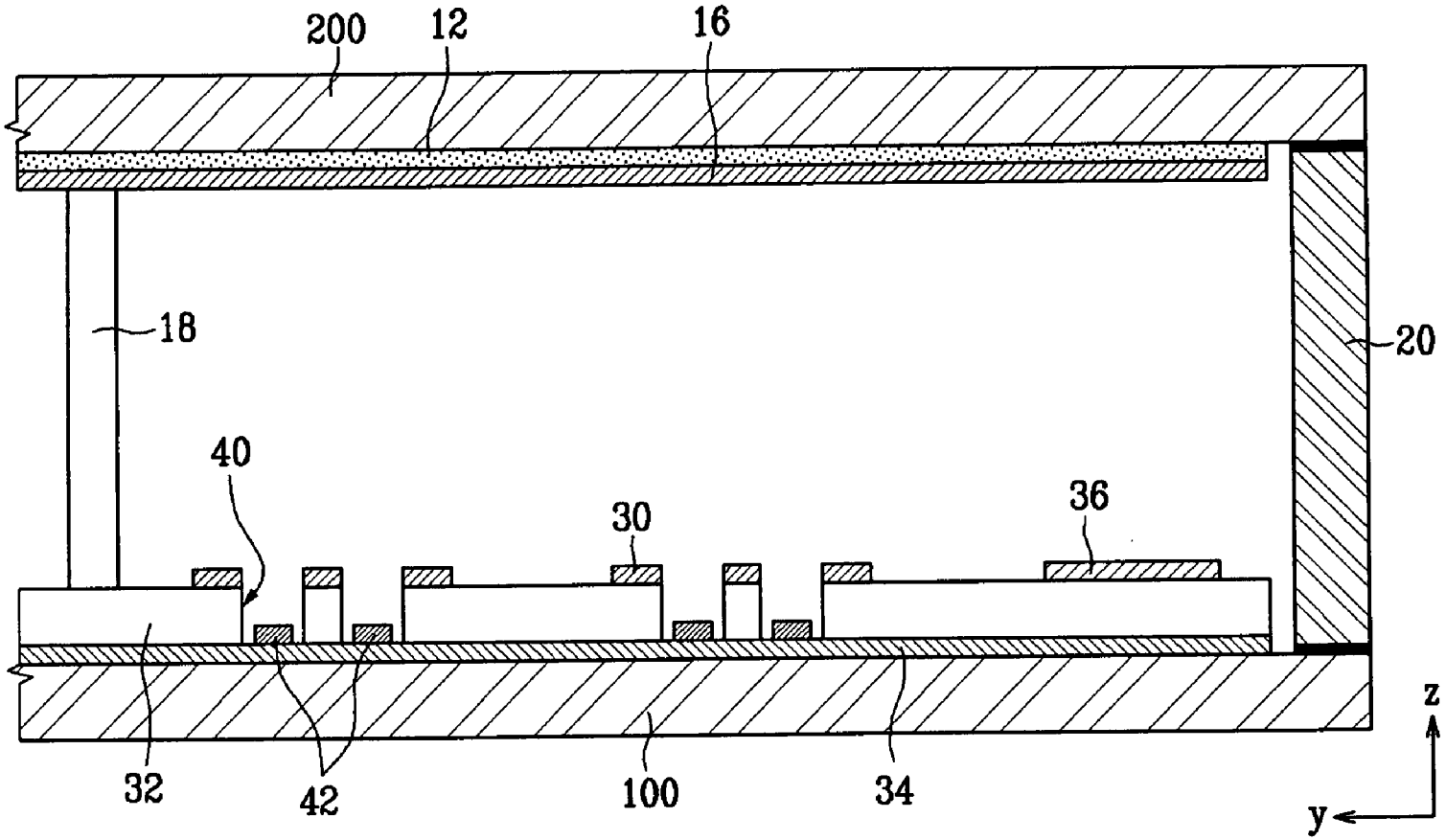
FIG. 6 is a partial sectional view of the electron emission device of FIG. 5, illustrating the combinatorial state thereof.

Although it is explained above that the gate electrodes 2 are placed under the cathode electrodes while interposing the insulating layer 4 therebetween, even with the structure of FIGS. 5 and 6, the gate electrodes 30 are placed over the cathode electrodes 34 while interposing the insulating layer 32 therebetween, the first and second dummy electrodes 36 and 38 can be arranged external to the effective electron emission area.

FIG. 5 is a partial exploded perspective view of an electron emission device according to a second embodiment of the present invention, and FIG. 6 is a partial sectional view of the electron emission device, illustrating the combinatorial state thereof.

As shown in the drawings, opening portions 40 are formed at the gate electrodes 30 and the insulating layer 32 per the respective pixel regions where the cathode electrodes 34 and the gate electrodes 30 cross each other. The opening portions 40 partially expose the cathode electrodes 34, and electron emission regions 42 are formed on the cathode electrodes 34 within the opening portions 40. A first dummy electrode 36 is placed external to the outermost gate electrode 30 parallel thereto, and a second dummy electrode 38 is placed external to the outermost cathode electrode 34 parallel thereto.

With the above structure, scan signals are applied to the gate electrodes 30, and data signals are applied to the cathode electrodes 34. The pixel on/off operation can be controlled by using the voltage difference between the gate and the cathode electrodes 30 and 34. In the process of driving such an electron emission device, the first and the second dummy electrodes 36 and 38 minimize the signal distortion within the effective electron emission area, and enable the precise on/off control of the respective pixels.

Figure 7:
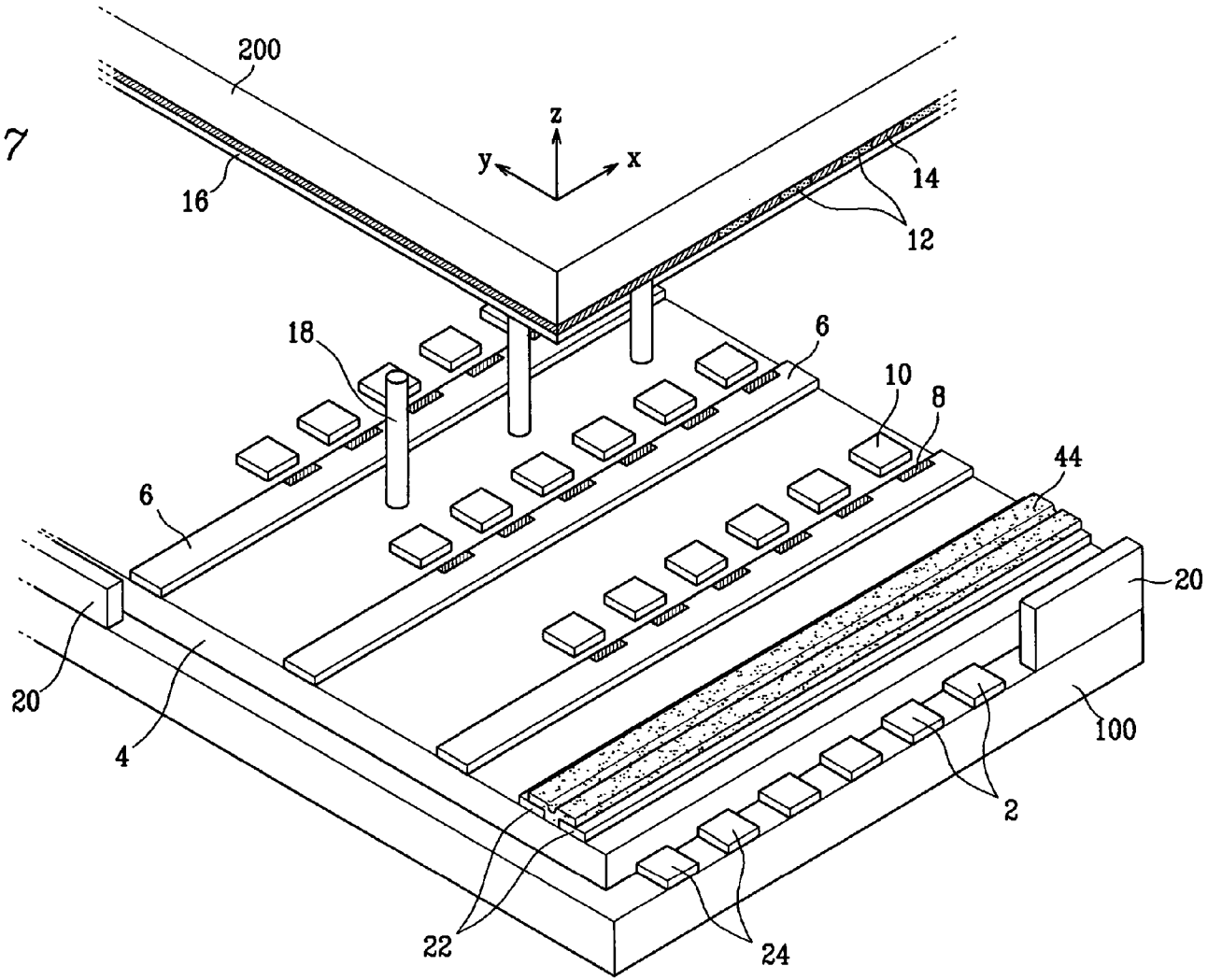
FIG. 7 is a partial exploded perspective view of an electron emission device according to a third embodiment of the present invention.
Figure 8:
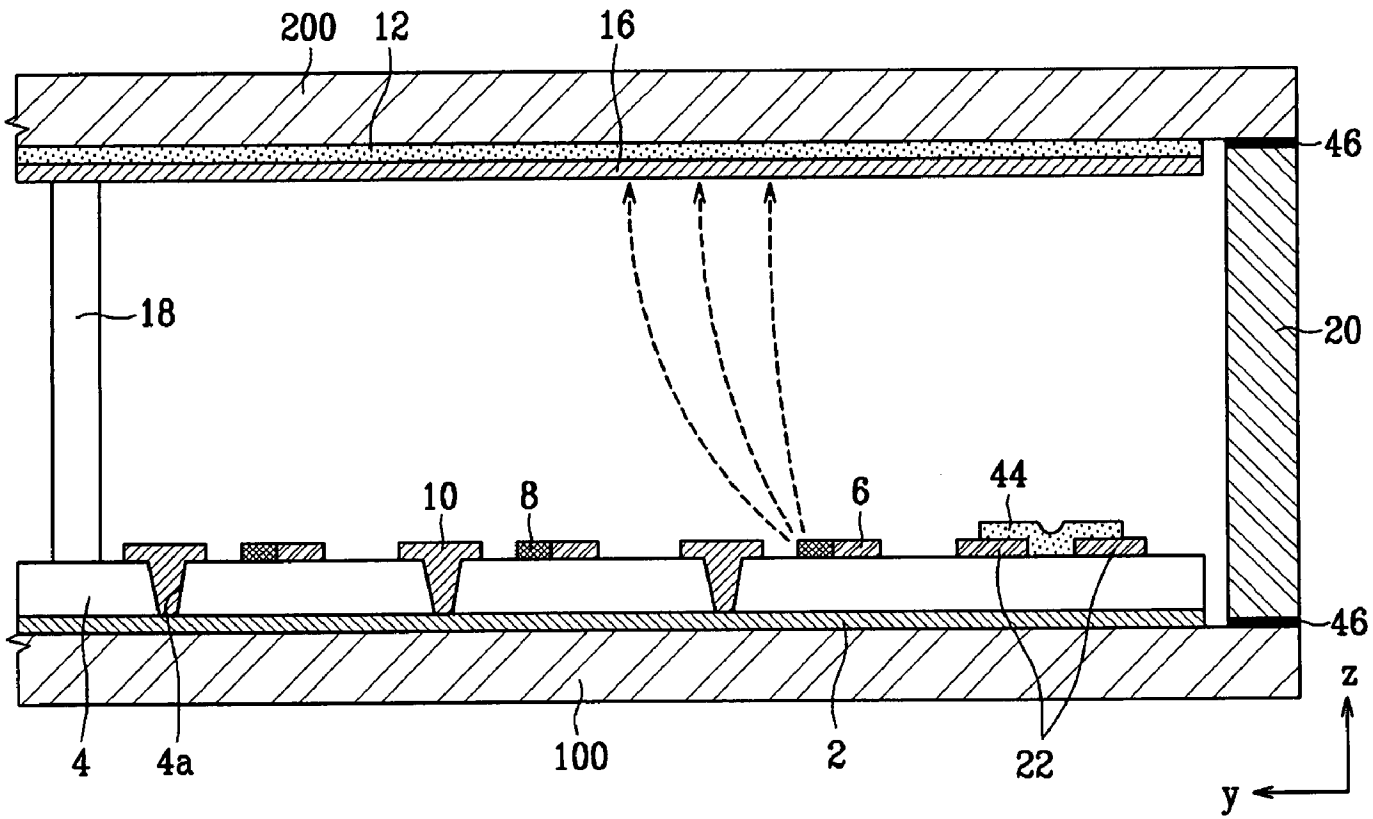
FIG. 8 is a partial sectional view of the electron emission device of FIG. 7, illustrating the combinatorial state thereof.

FIG. 7 is a partial exploded perspective view of an electron emission device according to a third embodiment of the present invention, and FIG. 8 is a partial sectional view of the electron emission device, illustrating the combinatorial state thereof. The electron emission device has the same basic structure as that of the first embodiment except that a getter layer is formed on the dummy electrodes.

Figure 9:
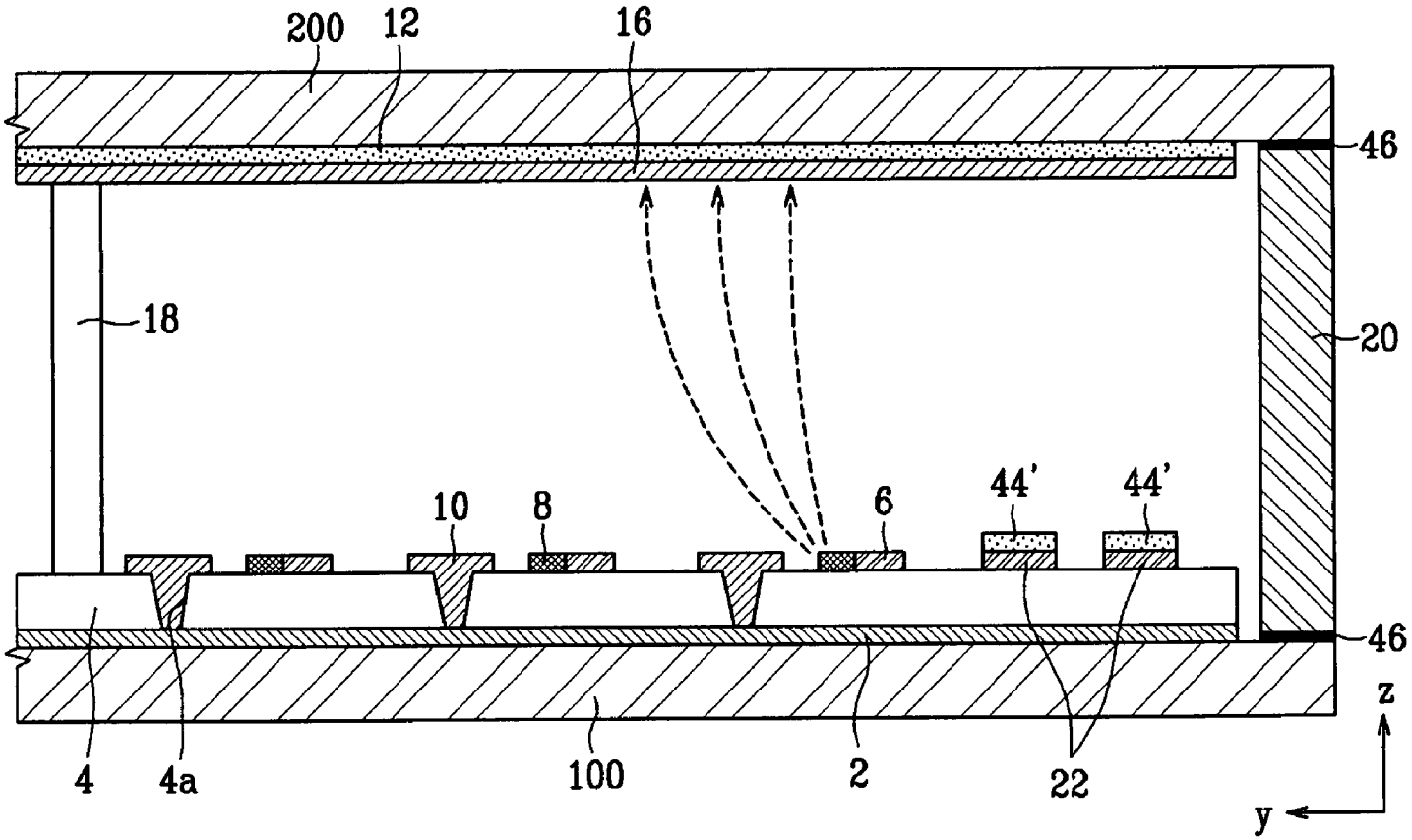
FIG. 9 is a partial sectional view of the electron emission device according to the third embodiment of the present invention, illustrating a variant of the getter layer thereof.

As shown in the drawings, a getter layer 44 is formed on the first dummy electrodes 22, and exposed toward the inner space of the electron emission device. For instance, the getter layer 44 is formed on the pair of first dummy electrodes 22 as well as on the insulating layer 4 disposed between the first dummy electrodes 22 in the direction of the first dummy electrodes 22. Alternatively, as shown in FIG. 9, the getter layer 44' can be formed on the first dummy electrodes 22 in the direction of the first dummy electrodes 22. In this embodiment, the getter layer 44 or 44' is a non-evaporable getter, and preferably formed of an alloy of zirconium and aluminum, or an alloy of zirconium, vanadium and iron.

Like the above, as the getter layer 44 is formed on the first dummy electrodes 22, the device space efficiency is enhanced, and after the exhausting, the remnant gas in the inner space is effectively collected and removed to thereby heighten the degree of vacuum.

That is, with the electron emission device according to the present embodiment, the above-described structural components are formed on the first and the second substrates 100 and 200, and the peripheries of the first and the second substrates 100 and 200 are sealed to each other using a side bar 20 and a frit 46. The inner space between the first and the second substrates 100 and 200 is exhausted, and a predetermined current is applied to the first dummy electrodes 22 to thereby activate the getter layer 44. The remnant gas after the exhausting is collected and removed through the activating of the getter layer 44 so that the inner space is kept in a high vacuum state.

The activation of the getter layer 44 is effected by applying 0.5-3 mA of current to the first dummy electrodes 22 for five minutes. The value or application time of current applied to the first dummy electrodes 22 are appropriately controlled depending upon the kind of the getter material, the thickness of the getter layer 44, the size of the first and second substrates 100 and 200, and the initial vacuum degree.

As described above, even though the electron emission device according to the present embodiment involves narrow inner spaces, the remnant gas after the exhausting is collected and removed using the getter layer 44, thereby heightening the degree of vacuum. The getter layer 44 covers at least one of the first dummy electrodes 22 such that a sufficient amount of getter material fills the inner spaces of the device, thereby enhancing the remnant gas collection efficiency.

The getter layer 44 can be formed of the same electron emission material as that of the electron emission regions 8, in addition to the non-evaporable getter material. The getter layer 44 is aged before the aging of the electron emission regions 8 within the effective electron emission area so that the remnant gas is early collected and removed by reacting the electron emission material of the getter layer 44 with the remnant gas.

Figure 10:
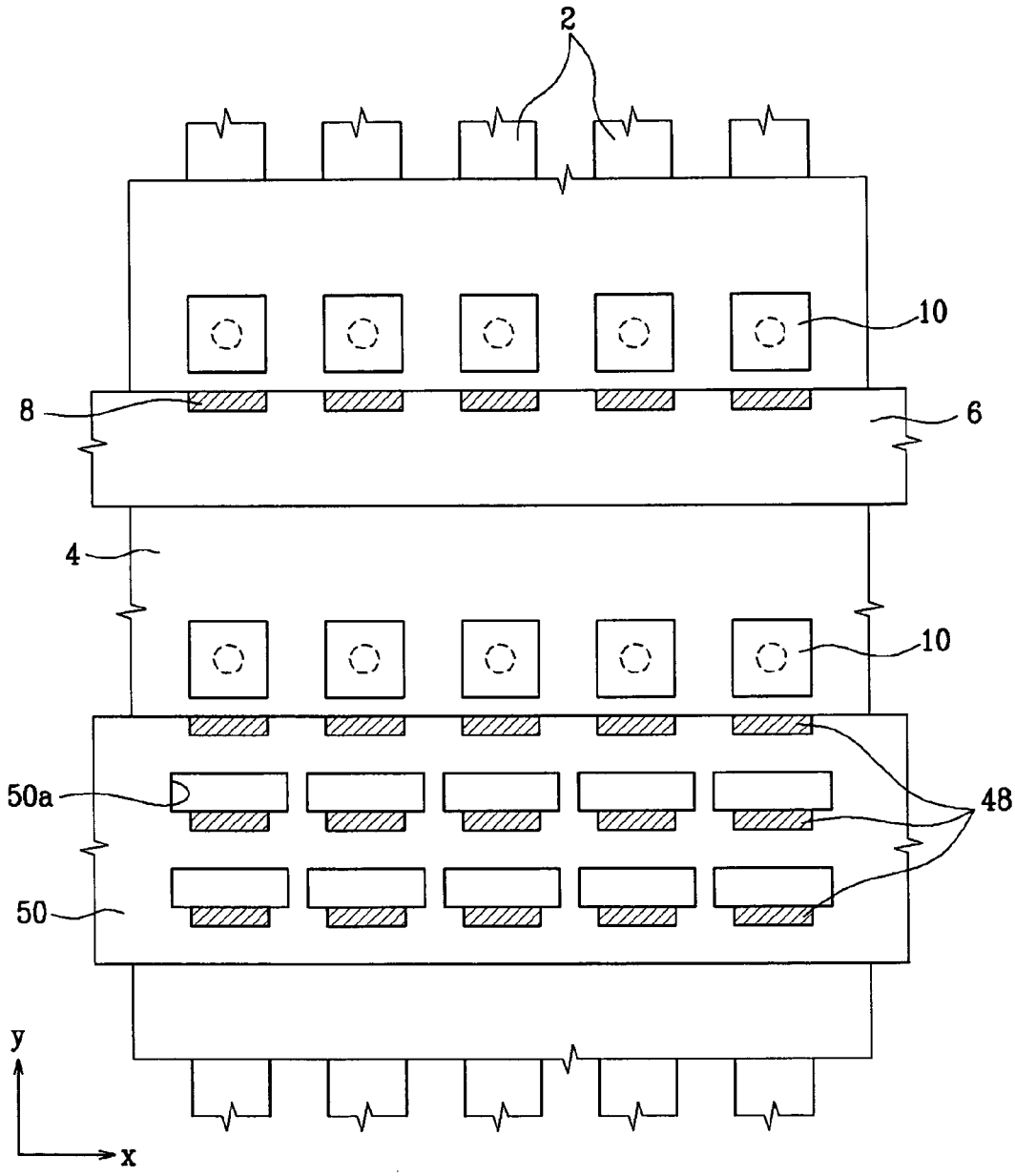
FIG. 10 is a partial plan view of a first substrate of an electron emission device according to a fourth embodiment of the present invention.

FIG. 10 is a partial plan view of a first substrate of an electron emission device according to a fourth embodiment of the present invention.

As shown in FIG. 10, getter layers 48 are formed at one side periphery of a first dummy electrode 50 facing counter electrodes 10. Preferably, the first dummy electrode 50 has a width larger than that of the cathode electrode 6 to increase the number of the getter layers 48. The portions of the first dummy electrode 50 crossing over the gate electrodes 2 are removed to form opening portions 50*a* exposing the insulating layer 4, and a getter layer 48 is formed at one side periphery of each opening portion 50*a*.

Consequently, the amount of the electron emission material of the getter layers 48 formed on the first dummy electrode 50 is larger than that of the electron emission regions 8 formed on the cathode electrodes 6, thereby heightening the remnant gas collection efficiency.

With the electron emission device according to the present embodiment, the above-described structural components are formed on the first and the second substrates 100 and 200, and the peripheries of the first and the second substrates 100 and 200 are sealed to each other using a side bar 20 and a frit 46. The inner space between the first and the second substrates 100 and 200 is exhausted, and sealed in a vacuum tight manner. The getter layers 48 are aged by applying an electric field thereto and emitting electrons therefrom, and the electron emission regions 8 are aged by applying an electric field thereto and emitting electrons therefrom.

Consequently, with the electron emission device according to the present embodiment, the electron emission material of the getter layers 48 reacts with the remnant gas during the step of aging the getter layers to thereby collect and remove the remnant gas, and the inner space of the device is kept to be in a high vacuum state.

During the aging of the getter layer 48, predetermined driving voltages are applied to the first dummy electrode 50 and the gate electrode 2 to thereby form an electric field around the getter layer 48. Specifically, when the getter layer 48 is aged, the voltages applied to the first dummy electrode 50 and the gate electrode 2 are beginning from the threshold value, and gradually increase. The applied voltages are higher than the normal driving voltage applied to the effective electron emission area by 30-50V or more. Accordingly, when an electron emission occurs from the electron emission regions 8, the getter layers 48 formed on the first dummy electrode 50 are prevented from emitting electrons. A lower voltage of 2 kV or less is applied to the anode electrode such that the arc discharge does not occur.

When the getter layers 48 are formed with the same electron emission material as that of the electron emission regions 8, for example, carbon nano-tubes, the harmful gas directly affecting the electron emission material of the electron emission regions 8 can be selectively removed from the effective electron emission area within the shortest distance. Accordingly, the electron emission device according to the present embodiment increases the life span of the electron emission regions 8, and enhances the evenness in the light emission of the screen, and the fullness thereof.

Figure 11:
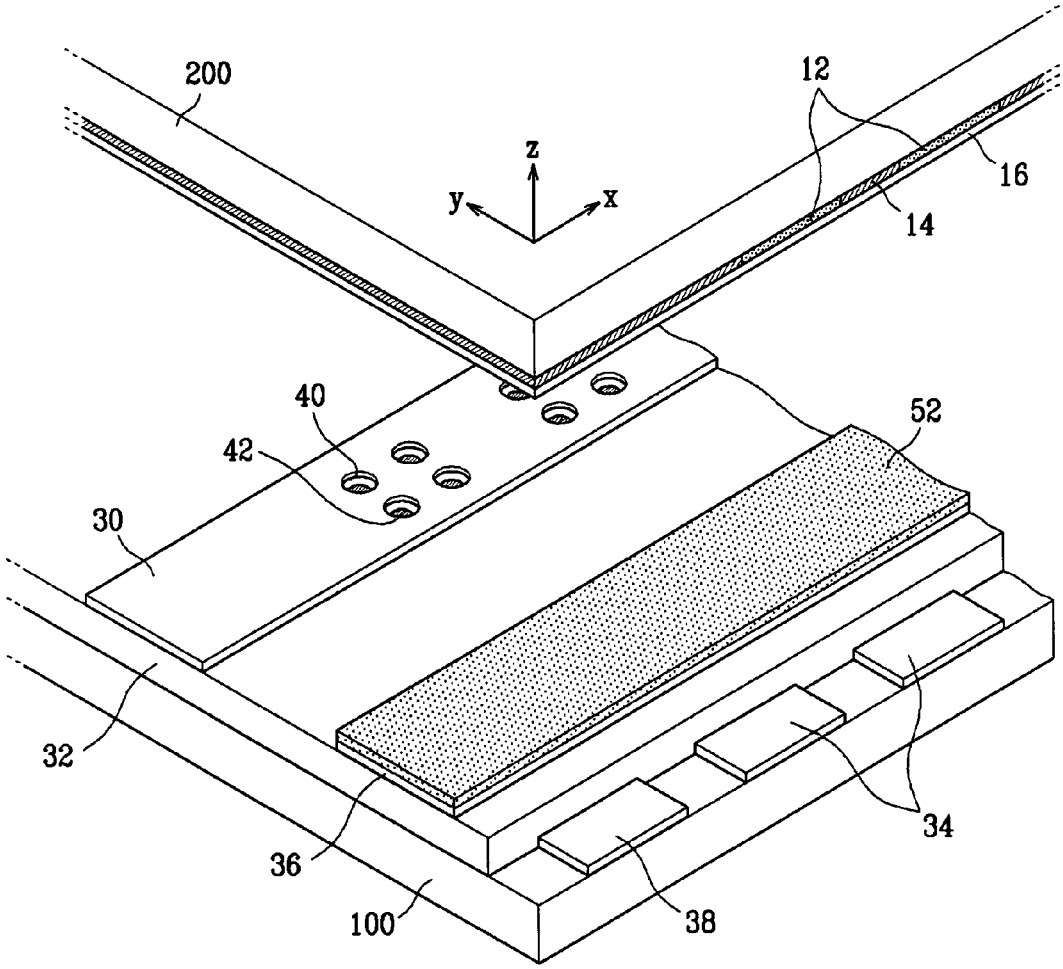
FIG. 11 is a partial exploded perspective view of an electron emission device according to a fifth embodiment of the present invention.
Figure 12:
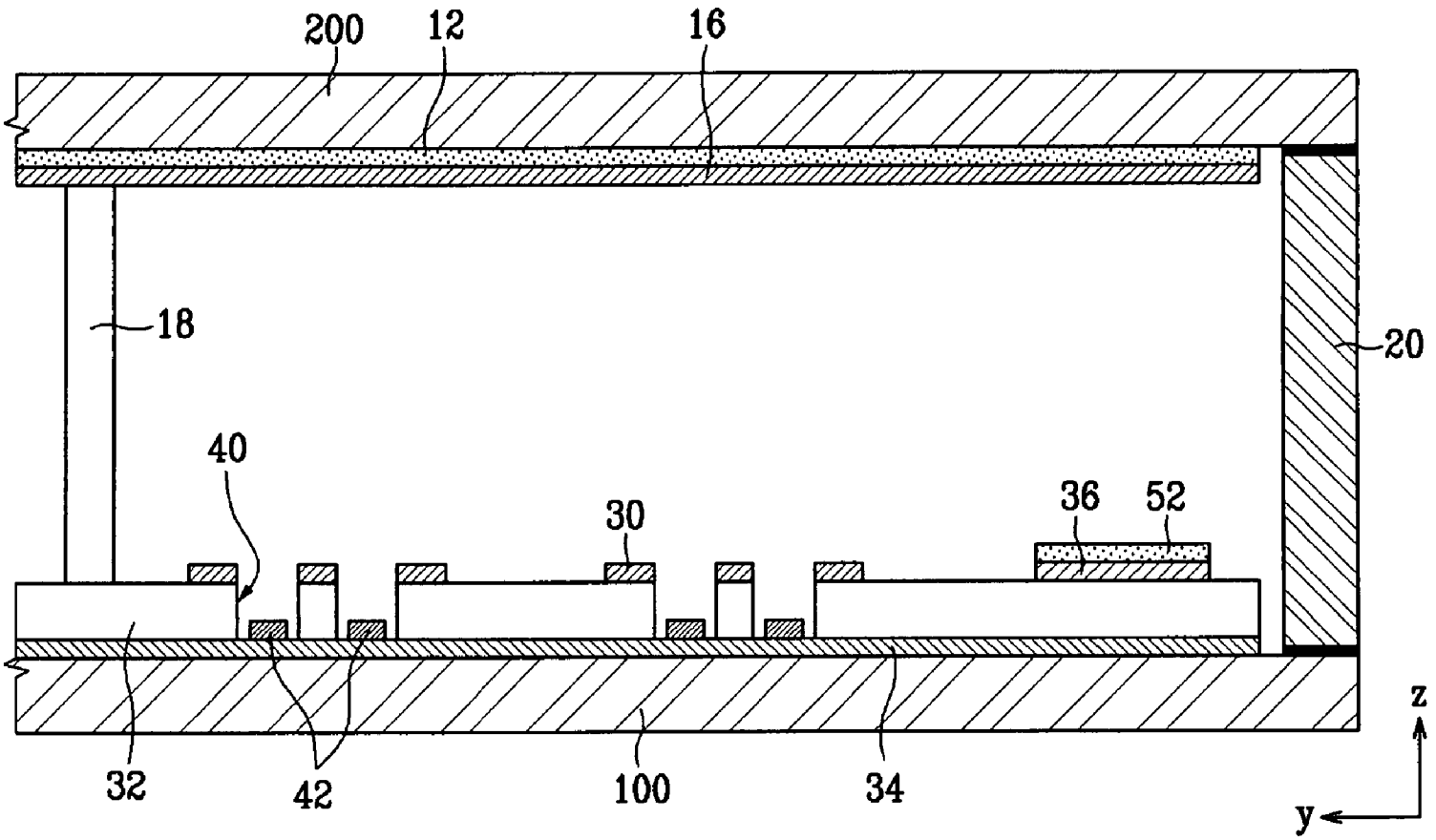
FIG. 12 is a partial sectional view of the electron emission device of FIG. 11, illustrating the combinatorial state thereof.

FIG. 11 is a partial exploded perspective view of an electron emission device according to a fifth embodiment of the present invention, and FIG. 12 is a partial sectional view of the electron emission device, illustrating the combinatorial state thereof. The electron emission device according to the present embodiment has the same basic structure as that related to the second embodiment except that a getter layer is formed on the dummy electrodes.

As shown in the drawings, a first dummy electrode 36 is placed external to the outermost gate electrode 30 parallel thereto, and a getter layer 52 is formed on the first dummy electrode 36 with a non-evaporable getter material. With this structure, after the inner space of the device is exhausted, current is applied to the first dummy electrode 36 to activate the getter layer 50, and collect and remove the remnant gas, thereby heightening the degree of vacuum. A second dummy electrode 38 is placed external to the outermost cathode electrode 34 parallel thereto.

Figure 13:
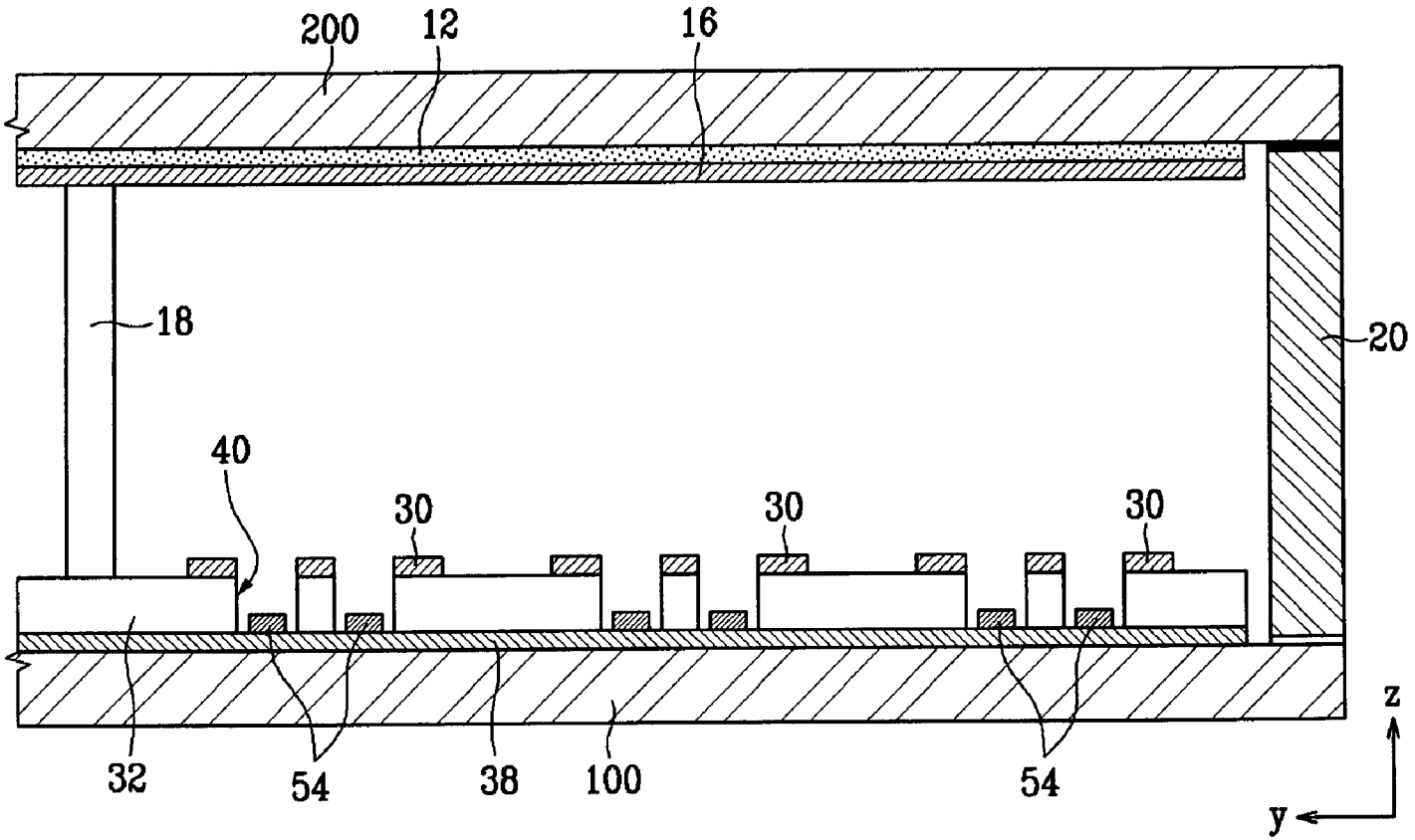
FIG. 13 is a partial sectional view of an electron emission device according to a sixth embodiment of the present invention.

FIG. 13 is a partial sectional view of an electron emission device according to a sixth embodiment of the present invention. The structural components of the electron emission device, such as cathode electrodes, gate electrodes, electron emission regions and first and second dummy electrodes, are the same those of the fifth embodiment, and getter layers 54 are formed on the second dummy electrode 38 with the same electron emission material as that of the electron emission regions.

When the inner space of the device is exhausted and predetermined driving voltages are applied to the second dummy electrode 38 and the gate electrode 30, an electric field is formed around the getter layers 54, and the getter layers 54 emit electrons. The electron emission material of the getter layer 54, for instance, carbon nano-tubes, reacts with the remnant gas in the device to collect and remove the harmful remnant gas while keeping the inner space of the device to be in a high vacuum state.

Although exemplary embodiments of the present invention have been described in detail hereinabove, it should be clearly understood that many variations and/or modifications of the basic inventive concept herein taught which may appear to those skilled in the art will lo still fall within the spirit and scope of the present invention, as defined by the appended claims.

What is claimed is:

1. An electron emission device comprising:

first and second substrates facing each other;

cathode and gate electrodes arranged on the first substrate within the effective electron emission area;

an insulating layer interposed between the cathode and gate electrodes;

electron emission regions electrically connected to the cathode electrodes;

at least one dummy electrode arranged external to the effective electron emission area;

at least one anode electrode arranged on the second substrate; and phosphor layers arranged on one surface of the anode electrode.

2. The electron emission device of claim 1, wherein the dummy electrode comprises at least one of a first dummy electrode arranged external to an outermost cathode electrode and parallel thereto, and a second dummy electrode arranged external to an outermost gate electrode and parallel thereto.

3. The electron emission device of claim 2, wherein an insulating layer is arranged between the first and the second dummy electrodes.

4. An electron emission device comprising:

first and second substrates facing each other;

first electrodes arranged on the first substrate and adapted to receive scan signals;

second electrodes insulated from the first electrodes by an insulating layer and adapted to receive data signals;

electron emission regions electrically connected to either the first electrodes or the second electrodes; and at least one dummy electrode arranged external to an outermost first electrode.

5. The electron emission device of claim 4, wherein the first electrodes comprise cathode electrodes, and the second electrodes comprise gate electrodes arranged under the cathode electrodes and including an insulating layer interposed therebetween, and wherein the electron emission regions are arranged on the first electrodes.

6. The electron emission device of claim 4, wherein the first electrodes comprise gate electrodes, and the second electrodes comprise cathode electrodes arranged under the gate electrodes and including an insulating layer interposed therebetween, and wherein the electron emission regions are arranged on the second electrodes.

7. An electron emission device comprising:

first and second substrates facing each other;

cathode and gate electrodes arranged on the first substrate within an effective electron emission area and including an insulating layer interposed therebetween;

electron emission regions electrically connected to the cathode electrodes;

at least one dummy electrode arranged external to the effective electron emission area and including a getter layer;

at least one anode electrode arranged on the second substrate;

phosphor layers arranged on one surface of the anode electrode; and a sealing member arranged at peripheries of the first and the second substrates and surrounding the dummy electrode, the sealing member adapted to seal the first and the second substrates together.

8. The electron emission device of claim 7, wherein the dummy electrode comprises a first dummy electrode arranged external to an outermost cathode electrode and parallel thereto, and a second dummy electrode arranged external to an outermost gate electrode and parallel thereto, and wherein the getter layer is arranged on at least one of the first and the second dummy electrodes.

9. The electron emission device of claim 7, wherein the getter layer comprises a non-evaporable getter material.

10. The electron emission device of claim 9, wherein the getter layer comprises one of an alloy of zirconium, vanadium and iron, and an alloy of zirconium and aluminum.

11. The electron emission device of claim 7, wherein the getter layer is arranged on the dummy electrode and the insulating layer in the direction of the dummy electrode.

12. The electron emission device of claim 7, wherein the getter layer comprises an electron emission material.

13. The electron emission device of claim 12, wherein the electron emission region and the getter layer comprise at least one material selected from the group consisting of carbon nano-tubes, graphite, graphite nano-fibers, diamonds, diamond-like carbon, $C_{60}$, and silicon nano-wires.

14. The electron emission device of claim 12, wherein an amount of electron emission material of the getter layer arranged on one of the dummy electrode lines is greater than an amount of electron emission material of the electron emission regions arranged on one of the cathode electrodes.

15. The electron emission device of claim 7, wherein the gate electrodes, the insulating layer and the cathode electrodes are sequentially arranged on the first substrate, and the dummy electrode is arranged external to an outermost cathode electrode and parallel thereto with a plurality of opening portions arranged at crossed regions of the dummy electrode and the gate electrodes to partially expose the insulating layer, and wherein the getter layer is arranged on one side periphery of the dummy electrode and one side peripheries of opening portions of the electron emission material.

* * * * *